United States Patent [19]

Ishii

[11] 4,350,093

[45] Sep. 21, 1982

[54] IMAGE POSITION ADJUSTING DEVICE FOR PRINTING MACHINE

[75] Inventor: Koji Ishii, Fuchu, Japan

[73] Assignee: Ryobi Ltd., Hiroshima, Japan

[21] Appl. No.: 212,377

[22] Filed: Dec. 3, 1980

[30] Foreign Application Priority Data

Dec. 5, 1979 [JP] Japan ..... 54-158527

[51] Int. Cl.[3] ..... B41F 5/02; B41F 5/22; B41F 13/12

[52] U.S. Cl. ..... 101/217; 101/229; 101/248

[58] Field of Search ..... 101/177, 178, 179–181, 101/182, 183, 184, 185, 217, 218, 220, 221, 136, 137, 138, 139, 142–144, 248, 229, 230, 231; 182/356, 20, 84 A, 84 AA; 74/333, 334, 335

[56] References Cited

U.S. PATENT DOCUMENTS 2,003,799 6/1935 Barber ..... 101/220
3,732,815 5/1973 Greiner et al. ..... 101/248 X
3,742,849 7/1973 Greiner et al. ..... 101/248 X

FOREIGN PATENT DOCUMENTS 2753433 5/1979 Fed. Rep. of Germany ..... 101/248

*Primary Examiner*—J. Reed Fisher
*Attorney, Agent, or Firm*—Sughrue, Mion, Zinn, Macpeak & Seas

[57] ABSTRACT

An image detecting and positioning device for an off-set printing machine capable of printing on both sides of a printing sheet. Electromagnetic clutches couple and disengage gears from the shafts of rubber cylinders in response to input signals with the two gears engaged with each other. Electromagnetic brakes are also coupled to the shafts of the rubber cylinders. Rotational angle detectors provide outputs related to the rotational positions of the shafts of one of the rubber cylinders and its plate cylinder. The electromagnetic brakes and clutches are operated in response to outputs from the rotational angle detectors to correctly position images on the rubber cylinders.

3 Claims, 7 Drawing Figures

IMAGE POSITION ADJUSTING DEVICE FOR PRINTING MACHINE

BACKGROUND OF THE INVENTION

The present invention relates to an image position adjusting device in an offset printing machine capable of printing on both sides of a sheet of paper.

In the field of offset printing, the demand for paper printing plates has recently increased following the development of paper plate manufacturing machines because the manufacturing cost per plate is low and the plate can be automatically mounted on the plate cylinder and removed therefrom. However, these plates suffer from a disadvantage that often the position of an image on the plate is shifted from that of the original during the plate manufacturing process. The amount of shift depends partially on the accuracy of the plate manufacturing machine itself. However, the amount of shift is also dependent upon the operator's skill in positioning the image part at a predetermined position on the plate. This is a considerably difficult operation in practice as the image part is liable to shift for every plate.

Because of the shift of the image part, during a printing operation it is necessary to readjust the image position to correctly determine the printing image position with respect to supplied sheets whenever the printing plate is replaced.

In an offset single-side printing machine, the plate cylinder, the rubber cylinder and the impression cylinder are coupled and driven by separate gears provided therefor while in an offset printing machine capable of printing on both sides, the plate cylinder and the rubber cylinder which are paired for the front side of a printing sheet and the plate cylinder and the rubber cylinder which are paired for the rear side are coupled and driven by gears provided therefor in such a manner that the cylinders are driven at the same circumferential speed and are maintained in a predetermined circumferential relation, that is, with a constant angular relation. With this arrangement, the image position can be adjusted by changing the circumferential coincidence relation between the cylinders.

A conventional image position adjusting device for a single-side printing machine is shown in FIGS. 1 and 2. A gear a′ is detachably secured to a rubber cylinder a with a retaining screw b and is maintained engaged with a gear c′ secured to an impression cylinder c at all times and establishing a circumferential coincidence relation between the rubber cylinder a and the impression cylinder c. To adjust the image position, the retaining screw b is loosened by turning a knob d′ provided at one end of a box wrench d to release the gear a′ from the rubber cylinder a. Thereafter, a gear g which is fixedly mounted on a shaft f supported by frames e and which is engaged with the gear a′ is turned with a handle h provided at one end of the shaft f to thereby turn the impression cylinder c through the gears a′ and c′ as a result of which the circumferential coincidence relation between the rubber cylinder a and the impression cylinder c is changed to achieve the image position adjustment. Thereafter, the retaining screw b is tightened with the box wrench d to fasten the gear a′ to the rubber cylinder a.

In the above-described conventional device, after the screw b has been loosened, the impression cylinder c is manually turned to change the circumferential coincidence relation between the cylinder c and the rubber cylinder a to achieve the image position adjustment. In reality, the adjustment is achieved by trial and error. Accordingly, it takes a long time for even a skilled person to accomplish the image position adjustment. In addition, when the screw b is tightened after the image position adjustment, the image position may again be shifted. Thus, the image position adjustment with the conventional device is low in accuracy and accordingly often it is necessary to repeat the adjustment several times.

Moreover, the image position adjustment is carried out with the printing machine stopped. Therefore, as the period that the printing machine is stopped increases, the plate surface becomes more and more dry as a result of which ink sticks to parts of the plate other than the image part. It is necessary to remove the excess dried ink by idling the machine although the printing operation could otherwise be started because the image position adjustment has been achieved. In the case of a paper printing plate, if ink sticks to parts of the paper plate other than the image part, it is impossible to use the paper plate again.

If the above-described conventional device is employed for the printing machine capable of printing on both sides, the accuracy becomes worse and the time required for image position adjustment is increased.

An object of the invention is thus to accomplish the front side image position adjustment and the rear side image position adjustment readily and quickly without requiring a high amount of operator skill.

SUMMARY OF THE INVENTION

In a novel image position adjusting device provided according to this invention in view of the above-described difficulties accompanying a conventional device, upon inputting of necessary amounts of image movement to an input section, a control section and rotational angle detectors control electromagnetic clutches, electromagnetic brakes and an electric motor, to automatically achieve the front side image position adjustment after which the rear side image position is adjusted.

More specifically, in accordance with this and other objects of the invention, a printing machine is provided having first and second plate cylinders and first and second rubber cylinders each of which is mounted for rotation on a shaft. Electromagnetic clutches couple gears to the shafts of the rubber cylinders with these gears engaged with each other. Electromagnetic brakes are provided which are operatively coupled to the shafts of the two rubber cylinders. Rotational angle detectors are provided for one of the rubber cylinders and plate cylinders. The electromagnetic clutches and brakes are operated in response to outputs of the rotational angle detectors.

DESCRIPTION OF THE PREFERRED EMBODIMENTS

Figure 1:
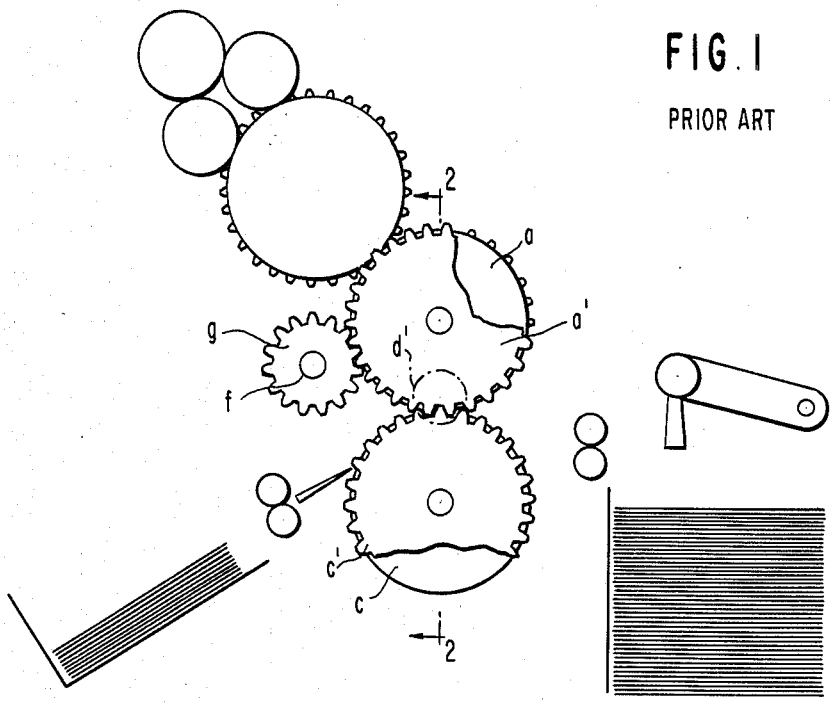
FIG. 1 PRIOR ART
FIG. 1 is a side view showing a single-side printing machine with a conventional image position adjusting device.
Figure 2:
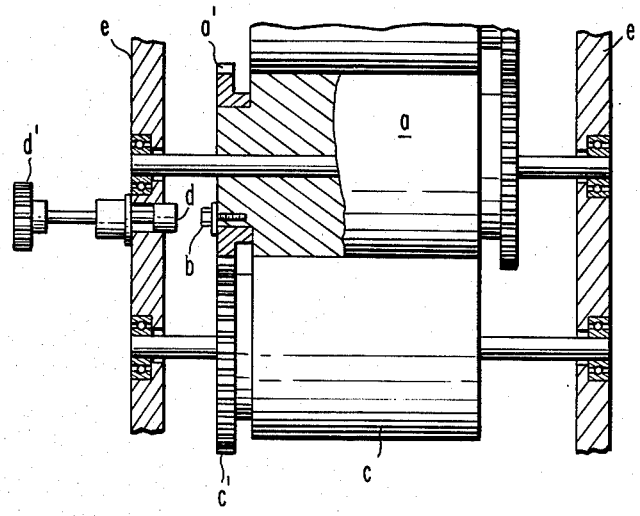
FIG. 2 PRIOR ART
FIG. 2 is a developed view of the printing machine of FIG. 1 taken along the line 2—2.
Figure 3:
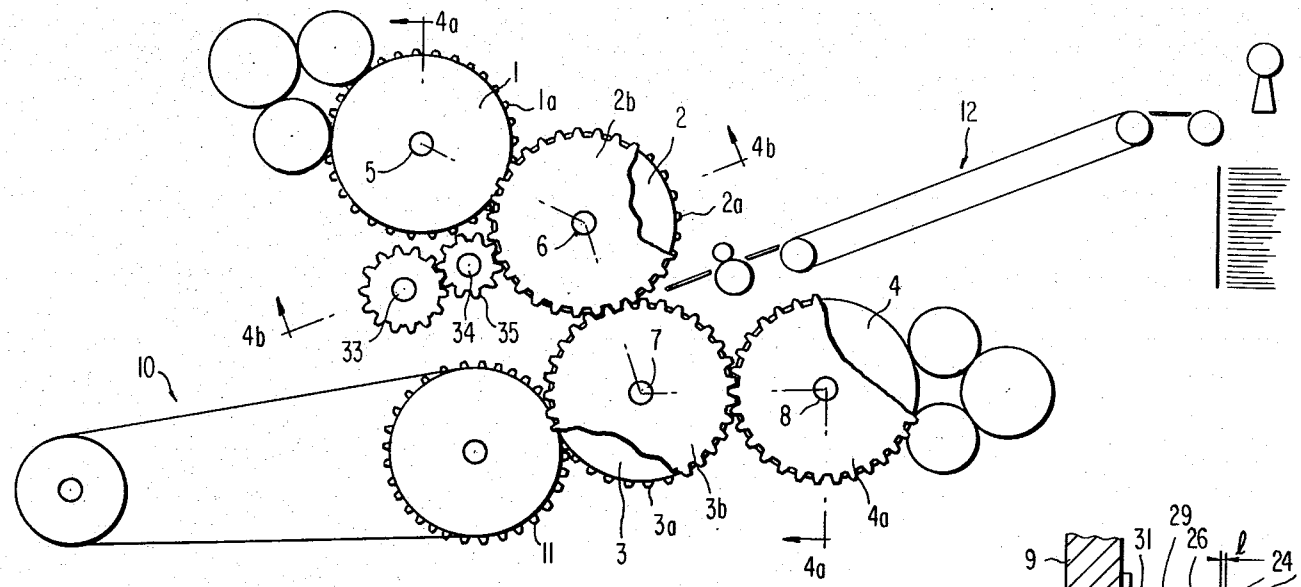
FIG. 3 is a side view showing a printing machine capable of printing on both sides with an image position adjusting device according to the invention.
Figure 4B:
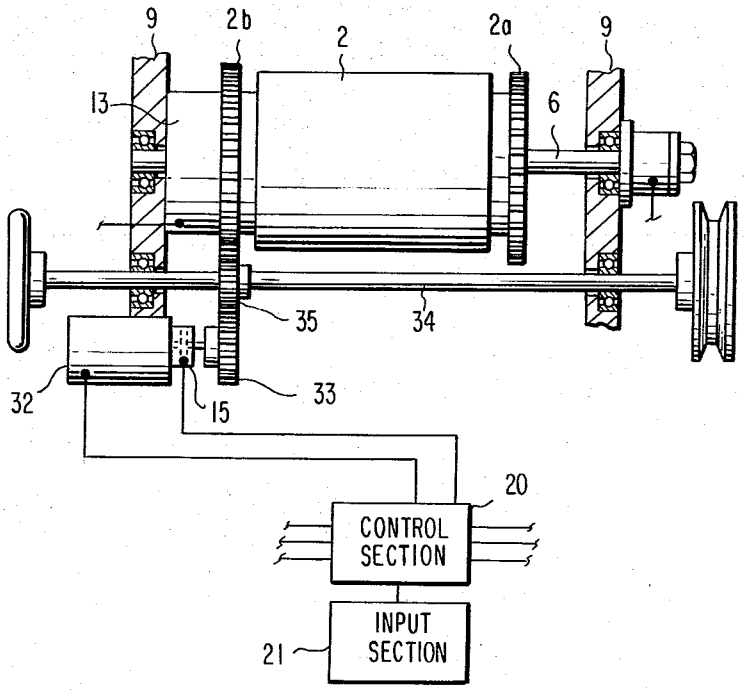
FIGS. 4*a* and 4*b* are developed views of the printing machine of FIG. 3 taken along lines 4*a*—4*a* and 4*b*—4*b*, respectively.
Figure 4A:
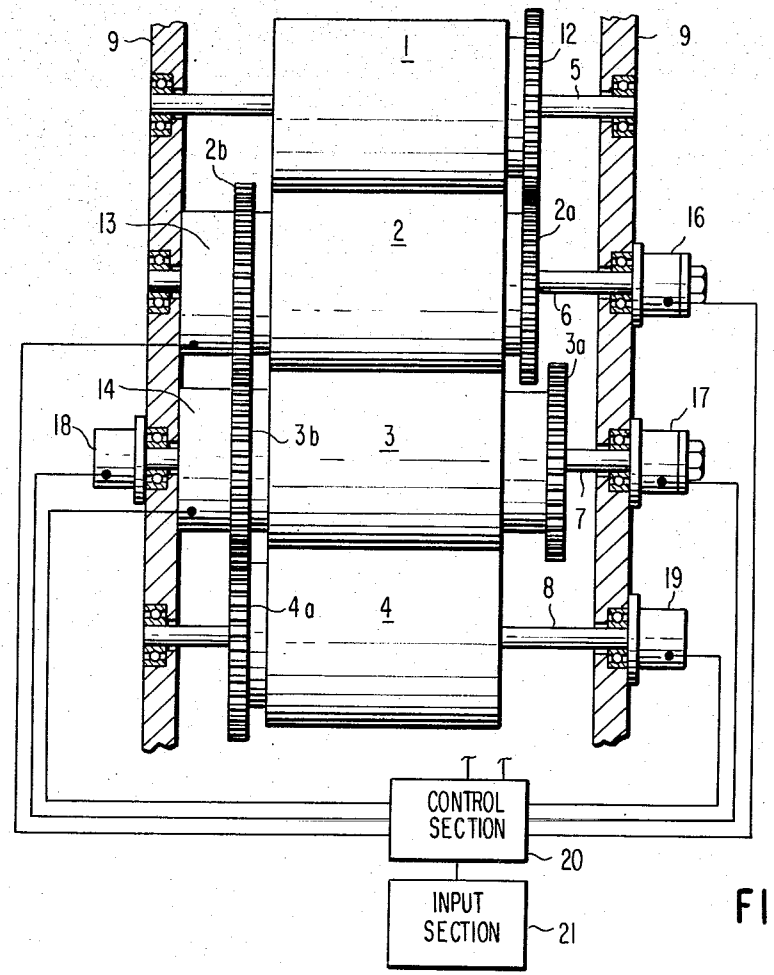

A preferred embodiment of the invention will be described with reference to FIGS. 3 through 5. In a printing machine capable of printing on both sides as shown in FIGS. 3, 4*a* and 4*b*, a plate cylinder 1 and a rubber cylinder 2 which are paired for the front side and a rubber cylinder 3 and a plate cylinder 4 which are paired for the rear side are rotatably supported by shafts 5, 6, 7 and 8, respectively, which are mounted on frames 9. Gears 1*a*, 2*a* and 2*b*, 3*a* and 3*b*, and 4*a* are provided for the cylinders 1, 2, 3 and 4, respectively. The gear 1*a* is engaged with the gear 2*a*, the gears 2*b*, 3*b* and 4*a* are engaged with one another, and the gear 3*a* is engaged with a drive gear 11 in a sheet discharging section 10 so that the cylinders are turned at the same circumferential speed and in the same circumferential coincidence relation. A printing sheet is supplied between the front side rubber cylinder 2 and the rear side rubber cylinder 3 from a sheeting supplying section 12 as shown in FIG. 3 as a resut of which printing is accomplished on both sides of the printing sheet with the rubber cylinders 2 and 3 simultaneously. The sheet is then discharged to the sheet discharging section 10.

The gears 1*a*, 2*a*, 3*a* and 4*a* are fixedly secured to the front side plate cylinder 1, the front side rubber cylinder 2, the rear side rubber cylinder and the rear side plate cylinder 4, respectively. The gears 2*b* and 3*b* are coupled so that they can be engaged with or disengaged from the front side rubber cylinder 2 and the rear side rubber cylinder 3 by means of electromagnetic clutches 13 and 14, respectively.

An image position adjusting device according to this invention includes the aforementioned electromagnetic clutches 13 and 14, an electromagnetic clutch 15, electromagnetic brakes 16 and 17, rotational angle detectors 18 and 19, a control section 20, an input section 21, and a single electric motor 32.

Figure 5:
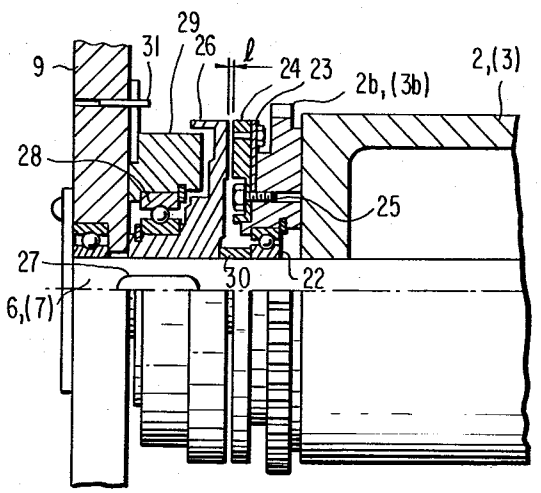
FIG. 5 is a plan view, partly as a sectional view, showing an electromagnetic clutch for causing a gear to engage with or disengage from a front or rear side rubber cylinder in the device shown in FIGS. 3 and 4.

As shown in FIG. 5, the electromagnetic clutch 13 (or 14) is rotatably supported through a bearing 22 on the shaft 6 (or 7) of the rubber cylinder 2 (or 3). An armature 24 is secured through a leaf spring 23 to the gear 2*b* (or 3*b*) on one end face of the rubber cylinder 2 (or 3) with a bolt 25. A rotor 26 is mounted on the shaft 6 (or 7) with a key 27 so as to be free from backlash in the direction of rotation. A field core 29 which is coupled through a bearing 28 to the peripheral portion of the rotor 26, is secured to the frame 9 with a retaining pin 31. A collar 30 is interposed between the bearing 22 and the rotor 26 to provide a small gap of width l between the armature 24 and the rotor 26.

Upon energization of the coil of the field core 29, magnetic flux is induced between the field core 29, the rotor 26 and the armature 24 as a result of which the armature 24 is attracted to the rotor 26 against the force of the leaf spring. This causes the gear 2*b* (or 3*b*) to be coupled to the rubber cylinder 2 (or 3). Upon deenergization of the coil, the armature is released from the rotor leaving again the gap of width l therebetween and thereby releasing the gear 2*b* (or 3*b*) from the rubber cylinder 2 (or 3) and allowing it to freely rotate.

Further, the electromagnetic clutch 15 causes the gear 33 to engage with the motor due to a magnetic force which is generated upon energization of the clutch 15. Upon deenergization, the gear 33 is disengaged from the motor 32. The gear 33 is engaged with the gear 2*b* of the front side rubber cylinder 2 through a gear 35 on the shaft 34 which is rotatably mounted on the frames 9. Accordingly, the motor 32 is operated to rotate the rear side rubber cylinder 3 and the rear side plate cylinder 4 through the gears 33, 35 and 2*b* for image position adjustment on both the front and rear sides.

The electromagnetic brakes 16 and 17 are supported on one of the frames 9 in correlation with the shafts 6 and 7 of the front side rubber cylinder 2 and the rear side rubber cylinder 3, respectively. Upon energization of the brakes 16 and 17, the rotation of the front side rubber cylinder 2 and the rear side rubber cylinder 3 is stopped through the shafts 6 and 7, respectively. Upon deenergization, the braking actions are released.

The rotational angle detectors 18 and 19 are supported on one of the frames 9 in correlation with the shafts 7 and 8 of the rear side rubber cylinder 3 and the rear side plate cylinder 4, respectively, so that the angles of rotation of the cylinders 3 and 4, corresponding to the amounts of image movement, can be detected from the rotation of the shafts 7 and 8, respectively.

The electromagnetic clutches 13, 14 and 15 and the electromagnetic brakes 16 and 17 are electrically connected and are controlled by the control section 20 in accordance with the outputs of the rotational angle detectors 18 and 19 in response to amounts of image movement required for the front and rear sides which are inputted to the input section 21.

With the device thus constructed, the front side image position can be adjusted by turning the rear side rubber cylinder 3 to change the circumferential coincidence relation between the front side rubber cylinder 2 and the rear side rubber cylinder 3 as the circumferential coincidence relation between the front side plate cylinder 1 and the front side rubber cylinder 2 is maintained constant. To adjust the circumferential coincidence relation between the front side plate cylinder 1 and the front side rubber cylinder 2, under the condition that the circumferential coincidence relation between the front side plate cylinder 1, the front side rubber cylinder 2 and the rear side rubber 3 is maintained constant, the rear side plate 4 is turned relative to these cylinders.

Specifically, the adjustment of the rear side and front side image positions and the printing operation are carried out by the control section 20 by energizing or deenergizing the electromagnetic clutches 13, 14 and 15 and the electromagnetic brakes 16 and 17 as indicated in the following Table:

TABLE

| | Clutch 13 | Clutch 14 | Clutch 15 | Brake 16 | Brake 17 |
|---|---|---|---|---|---|
| Front side image position adjustment (rear side rubber cylinder and rear side plate cylinder rotation) | OFF | ON | ON | ON | OFF |

TABLE-continued

| | Clutch 13 | Clutch 14 | Clutch 15 | Brake 16 | Brake 17 |
|---|---|---|---|---|---|
| Rear side image position adjustment (rear side plate cylinder rotation) | OFF | OFF | ON | ON | OFF |
| Printing | ON | ON | OFF | OFF | OFF |

The amount of image movement on the front side is detected by the rotational angle detector 18 which is provided in association with the shaft 7 of the rear side rubber cylinder 3. Similarly, the amount of image movement on the rear side is detected by the rotational angle detector 18 which is provided in association with the shaft 8 of the rear side plate cylinder 4.

In the case where the front side image and the rear side image are both shifted in position because of inaccuracies during the plate manufacturing process, the position adjustment is carried out as follows. With the cylinders are maintained stopped, the amounts of image movement for the front side and the rear side are inputted to the input section 21. The electromagnetic clutches 14 and 15 are not energized and the electromagnetic brake 16 is energized while the electromagnetic brake 17 is not energized. Therefore, the rotation of the motor 32 is transmitted to the gears 33, 35 and **3*b* to turn the rear side rubber cylinder and the rear side plate cylinder to change the circumferential coincidence relation while the rotation angle is being detected by the rotational angle detector 18 and is inputted to the control section 20. When the rotational angle this inputted coincides with the value which has been inputted, the front side image position adjustment is accomplished. Then, the electromagnetic clutch 13 is energized and the electromagnetic clutch 15 is deenergized while the remaining electromagnetic clutch 14 is deenergized and the electromagnetic brake 17 is energized. As a result, the rotation of the rubber cylinders 2 and 3 is stopped and only the rear side plate cylinder 4 is turned to change the circumferential coincidence relation between the plate cylinder 4 and the rear side rubber cylinder 3 while the rotation 4 and the rear side rubber cylinder 3 while the rotation angle is detected by the rotational angle detector 19 and is inputted to the control section 20. When the rotational angle thus inputted coincides with the value which has been inputted, the motor 32 is stopped. At the same time, as indicated in the Table above, the electromagnetic clutches 13 and 14 are energized to cause the gears 2*b* and 3*b* to engage respectively with the rubber cylinders 2 and 3 while the electromagnetic clutch 15 and the electromagnetic brakes 16 and 17** are deenergized. Thus, the image position adjustments for the front and rear sides have been accomplished and the printing operation can be commenced.

Even when the printing machine is driven, the circumferential contact relation between the front side rubber cylinder 2 and the rear side rubber cylinder 3 is maintained unchanged because the gears **2*b* and 3*b* are engaged with the rubber cylinders 2 and 3 by means of the electromagnetic clutches 13 and 14**, respectively.

Figure 6:
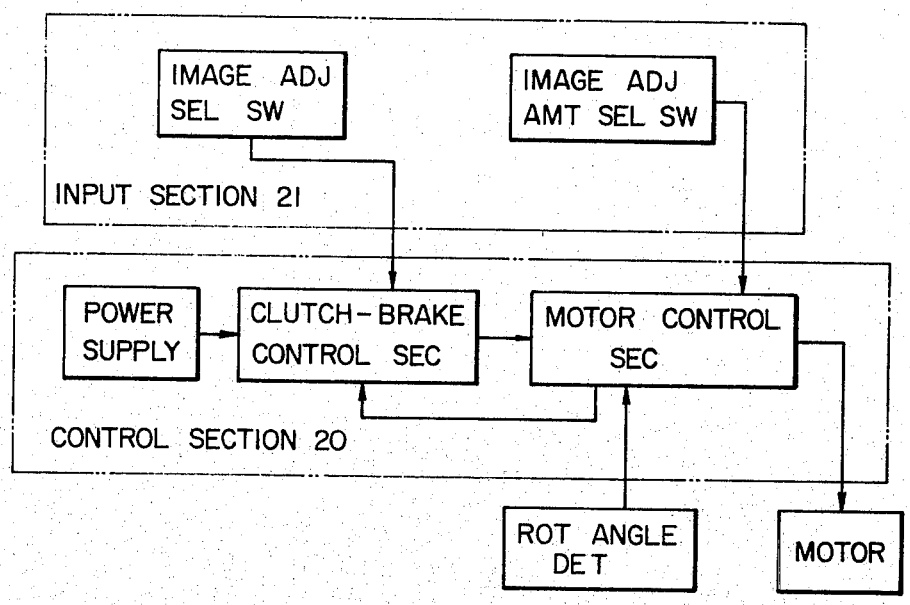
FIG. 6 is a block schematic diagram of a circuit used to operate the device of FIGS. 3 and 4.

The control section 20 and input section 21 can be implemented most simply by a set of operator-actuable manual switches coupled between the appropriate power source and the electromagnetic clutches 13 and 18 and the electromagnetic brakes 16 and 17 and a readout device, such as a digital counter or the like, coupled to the output of the rotational angle detectors. The operator controls the positions of the switches in accordance with the Table above and with the value displayed by the readout device. Alternately, the control section 20 and input section 21 can be implemented as chosen in FIG. 6 using electronic circuitry.

As is apparent from the above description, according to the image position adjusting device for the printing machine of the invention, when the image movement data required for the front and rear side is inputted to the input section 21, the control section 20 in accordance with the outputs of the rotational angle detectors 18 and 19, controls the electromagnetic clutches 13, 14 and 15, the electromagnetic brakes 16 and 17 and the motor 32 to turn the rear side rubber cylinder 3 only thereby to change the circumferential relation between the rubber cylinder 3 and the plate cylinder 1 and the rubber cylinder 2 on the front side thus achieving the front side image position adjustment. Then, only the rear side plate cylinder 4 is turned to change the circumferential coincidence relation between the plate cylinder 4 and the other cylinders thus automatically accomplishing the rear side image position adjustment.

As can now be readily appreciated, the device according to the invention is advantageous in that the image position adjustments for the front and rear side can be achieved readily and accurately even by an unskilled operator and that the front side image position adjustment and the rear side image position adjustment can be achieved successively in a short period of time.

What is claimed is:

1. A printing machine for printing on both sides of a printing sheet comprising: a first plate cylinder mounted for rotation on a first shaft and having a first gear coupled thereto; a first rubber cylinder mounted for rotation on a second shaft and having a second gear rigidly secured to said second shaft and engaged with said first gear; a first electromagnetic clutch and third gear, said first electromagnetic clutch being operatively mounted to engage and disengage said third gear with said second shaft; a second rubber cylinder mounted for rotation on a third shaft; a second electromagnetic clutch and fourth gear, said second electromagnetic clutch being operatively mounted to engage and disengage said fourth gear with said third shaft, said fourth gear being engaged with said third gear; first and second electromagnetic brakes, said first electromagnetic brake being operatively coupled to said second shaft and said second electromagnetic brake being operatively coupled to said third shaft; a second plate cylinder mounted for rotation on a fourth shaft and having a fifth gear fixedly secured to said fourth shaft which is engaged with said fourth gear; first and second rotational angle detectors coupled to operate in response to angular positions of said third and fourth shafts, respectively; an electric motor; and a third electromagnetic clutch operatively coupling said motor to said third gear.

2. The printing machine of claim 1 further comprising switching means electrically coupled to operate each of said electromagnetic clutches and said electromagnetic brakes.

3. The printing machine of claim 1 further comprising a sixth gear fixedly secured to said third shaft, said sixth gear being engaged with a drive gear of a sheet discharging section.

* * * * *